US006866162B2

(12) United States Patent
Morris, Sr.

(10) Patent No.: US 6,866,162 B2
(45) Date of Patent: Mar. 15, 2005

(54) OPEN ENDED CONTAINER WITH TAMPER INDICATOR

(75) Inventor: Glenn H. Morris, Sr., Chattanooga, TN (US)

(73) Assignee: M & M Industries, Inc., Chattanooga, TN (US)

( * ) Notice: Subject to any disclaimer, the term of this patent is extended or adjusted under 35 U.S.C. 154(b) by 0 days.

(21) Appl. No.: 10/270,828

(22) Filed: Oct. 15, 2002

(65) Prior Publication Data

US 2004/0020929 A1 Feb. 5, 2004

Related U.S. Application Data

(63) Continuation-in-part of application No. 10/127,892, filed on Apr. 22, 2002, now Pat. No. 6,776,302.

(51) Int. Cl.[7] ..... B65D 41/04

(52) U.S. Cl. ..... 220/288; 220/324; 220/326; 220/214

(58) Field of Search ..... 220/288, 265, 220/214, 324, 326; 215/250, 252, 253

(56) References Cited

U.S. PATENT DOCUMENTS 4,732,288 A * 3/1988 Morris, Sr. ..... 215/214
4,967,926 A * 11/1990 Morris, Sr. ..... 220/323
4,989,739 A * 2/1991 Falcone et al. ..... 215/221
5,373,959 A * 12/1994 Haasewinkel ..... 220/324
5,377,858 A * 1/1995 Morris, Sr. ..... 220/254.8
5,893,475 A * 4/1999 May ..... 215/252
5,915,575 A * 6/1999 Morris, Sr. ..... 215/214
6,021,917 A * 2/2000 Lovell et al. ..... 220/782

FOREIGN PATENT DOCUMENTS

EP 0 595 498 A1 * 10/1992

* cited by examiner

*Primary Examiner*—Robin A. Hylton
(74) *Attorney, Agent, or Firm*—Stephen J. Stark; Miller & Martin PLLC

(57) ABSTRACT

A container assembly has a lid which connects to an open ended container. The container has a wall which defines a cavity therein and has an outer surface with a plurality of outwardly directed teeth and at least outwardly directed thread. The teeth are located intermediate the threads and a top of the container wall. The lid has an outer wall with inwardly directed teeth which cooperate with the outwardly directed teeth on the exterior surface of the container. The lid also has a first opening in a ridge which allows at least a portion of a tamper indicator to extend therethrough, the tamper indicator, when installed, is biased toward a center of the lid in a first position so that a leg is brought into contact with the teeth on the container. The lid may not be removed without breaking a portion of the tamper indicator. Additionally, the teeth and leg may be configured to allow for the lid to be tightened relative to the container in the first position, but not loosened.

20 Claims, 4 Drawing Sheets

OPEN ENDED CONTAINER WITH TAMPER INDICATOR

CLAIM OF PRIORITY

This application is a continuation-in-part of U.S. patent application Ser. No. 10/127,892 filed Apr. 22, 2002 now U.S. Pat. No. 6,776,302.

BACKGROUND OF THE INVENTION

The present invention relates to a threaded closure assembly, and more particularly, to an open ended container having a lid provided with a tamper indicator.

Many resources have been devoted to providing an improved locking lid which cooperates with an open end container. U.S. Pat. Nos. 4,732,288, 4,967,926, 5,125,538, 5,377,858, and 5,915,575 each show improvements to the container assemblies wherein the top, or lid, has a locking feature relative to the open end container. While these locking lid assemblies are satisfactory for their intended purposes, they all provide no way to tell if the lids have been removed and replaced.

It is not unusual for some containers to be opened for one reason or another without authorization. For instance, a dishonest customer may open a first container, remove some product into a second container and close the lid on the first container and put it back on the shelf. Since most containers are not equipped with tamper indicators, the later purchaser of the first container has been cheated out of some of the product.

Additionally, some owners of containers may want to ensure that children or other persons do not get into certain containers. If the containers can't always be located in a secure environment, there is often no way to easily tell whether or not they have been inappropriately opened.

In spite of the improvements which have been developed with containers, a need still exists to develop an improved container. Furthermore, a need exists to provide a tamper indicator which indicates when the top has been removed from the pail.

SUMMARY OF THE INVENTION

Consequently, it is an object of the present invention to provide a lid assembly, and preferably a locking lid assembly for use with open ended containers wherein the container has a tamper indicator.

It is a further object of the present invention to provide a simple, effective tamper indication system for use with plastic pails and lids.

It is another object of the present invention to provide a lid having a locking top with a tamper indicator.

Accordingly, a container assembly has an open ended container with outwardly radially directed teeth proximate to the open end on an outer surface of the container. Threads are located on the outer surface of the container below the outwardly directed teeth. A lid with inwardly directed threads cooperates with the outwardly directed threads on the outer surface of the container to allow the lid to be threaded onto the container.

A locking mechanism used with the lid includes an arm which is configured to engage the teeth. The arm extends downwardly through an opening in a ridge which connects the outer wall to a central disc member. The arm is biased towards the central disc member. As the lid is threaded onto the container, the arm of the locking mechanism contacts the teeth. The arm preferably includes a slanted blade configured to cooperate with the teeth to allow the top to be tightened, but resist the loosening of the top without first disengaging the arm from the teeth by moving a finger connected to the arm radially outwardly to disengage the arm from the teeth.

The lid is also configured to provide a tamper indicator. The tamper indicator preferably includes a stop tethered to the finger of the locking mechanism. The stop is inserted through a second opening in the ridge. The stop has a rest which allows for the positioning of the stop in the opening at a desired position relative to the ridge, and biased barbs retain the stop at the desired position in the second opening. The barbs are displaced during the installation of the stop, but subsequently return to their normal configuration upon passing through the opening to the installed position. The barbs prevent the stop from being pulled back out of the second opening without a portion of the stop breaking.

The stop prevents the lid from opening when installed as it has a protrusion which engages the teeth on the container and will not allow for outward rotation of the lid. Accordingly, the stop must be broken, such as by lifting up on a lip which breaks the stop thereby allowing the protrusion to drop out of engagement with the teeth and allow the lid to be removed from the container. Since the stop is now broken, it now indicates that the lid has been removed from the pail and/or the tamper indicator has been purposefully triggered.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
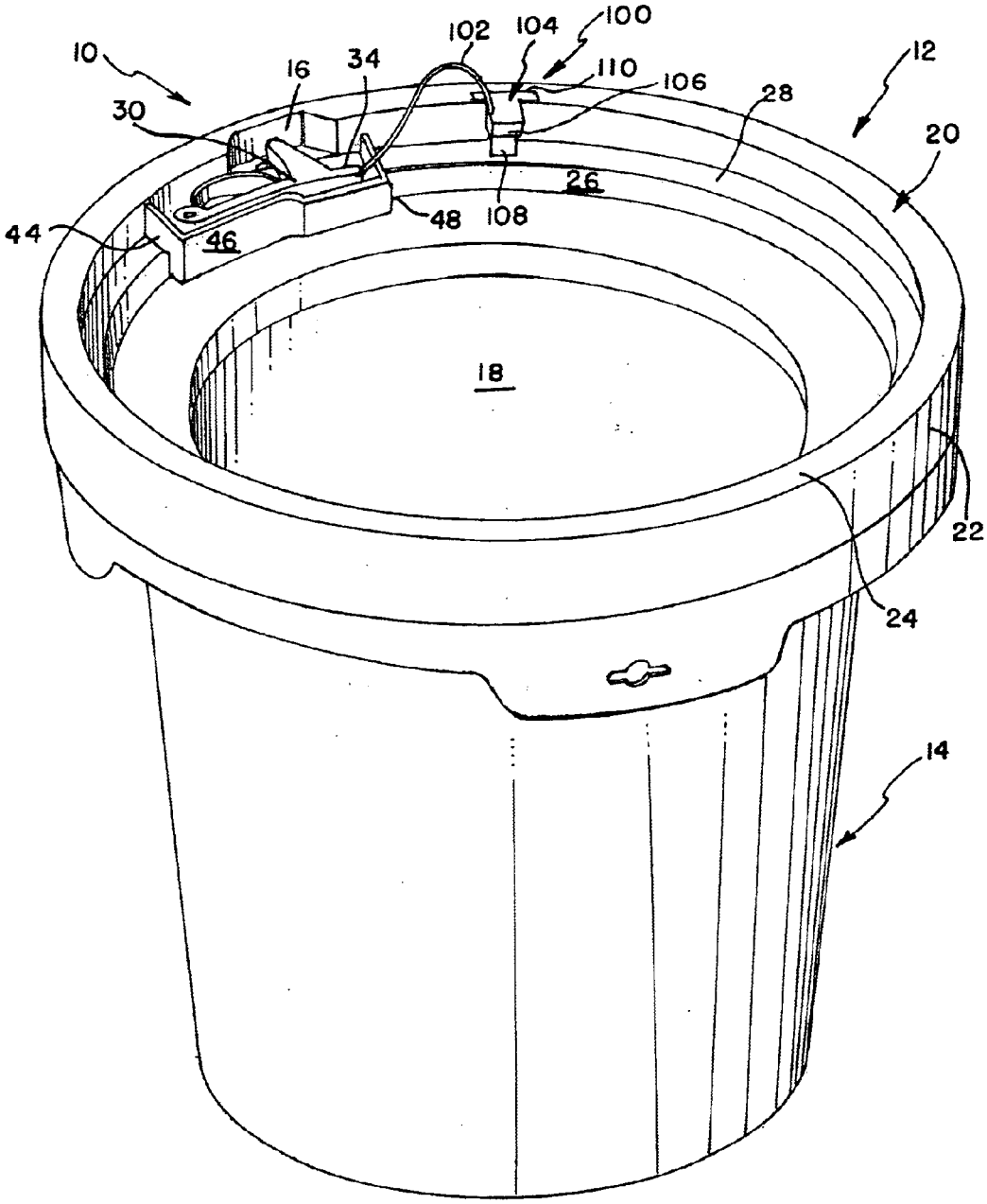
FIG. 1 is a top elevational view of an open ended container with a lid having a locking mechanism and an installed tamper indicator in accordance with the preferred embodiment of the present invention.

FIG. 1 shows a container assembly 10 comprising a lid 12 and an open ended container 14. A locking mechanism 16 resists the removal of the lid 12 from the container 14 when the lid 12 has been connected to the container 14.

Figure 2:
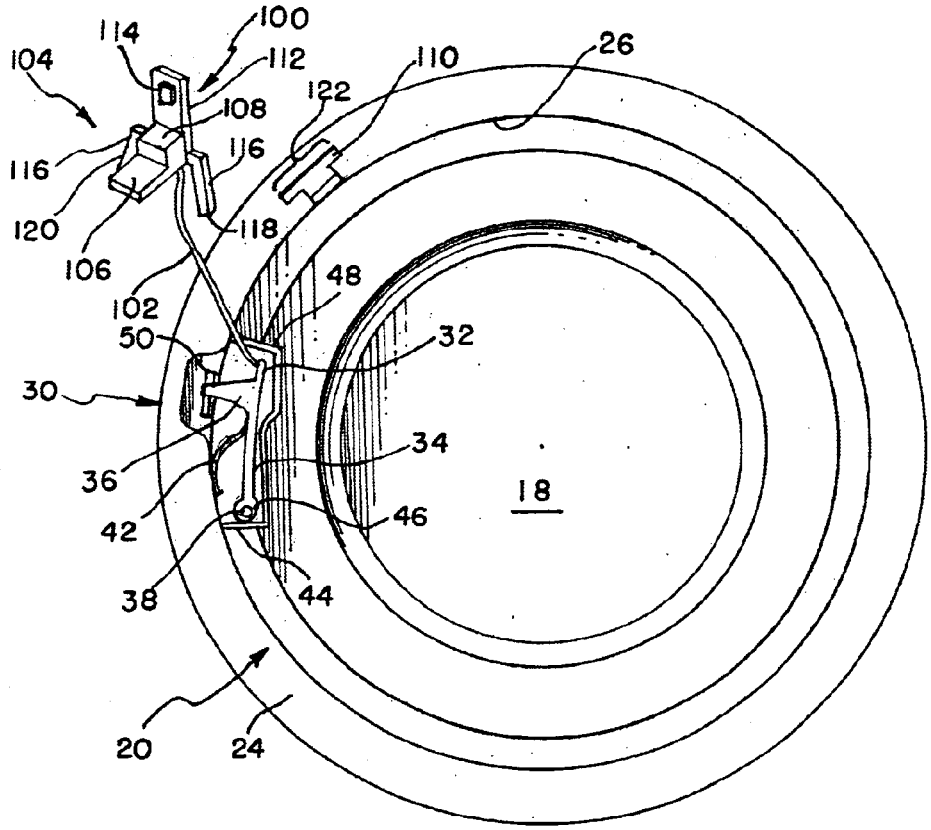
FIG. 2 is a top plan view of the lid shown in FIG. 1 prior to the installation of the tamper indicator.
Figure 3:
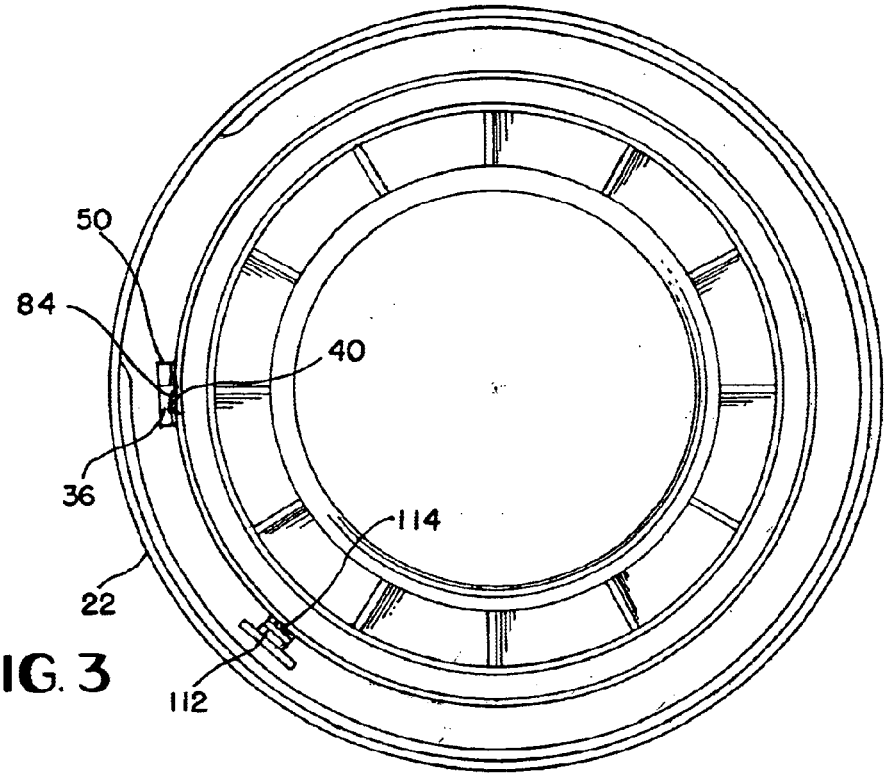
FIG. 3 is a bottom plan view of the lid shown in FIG. 2 with the tamper indicator installed.
Figure 4:
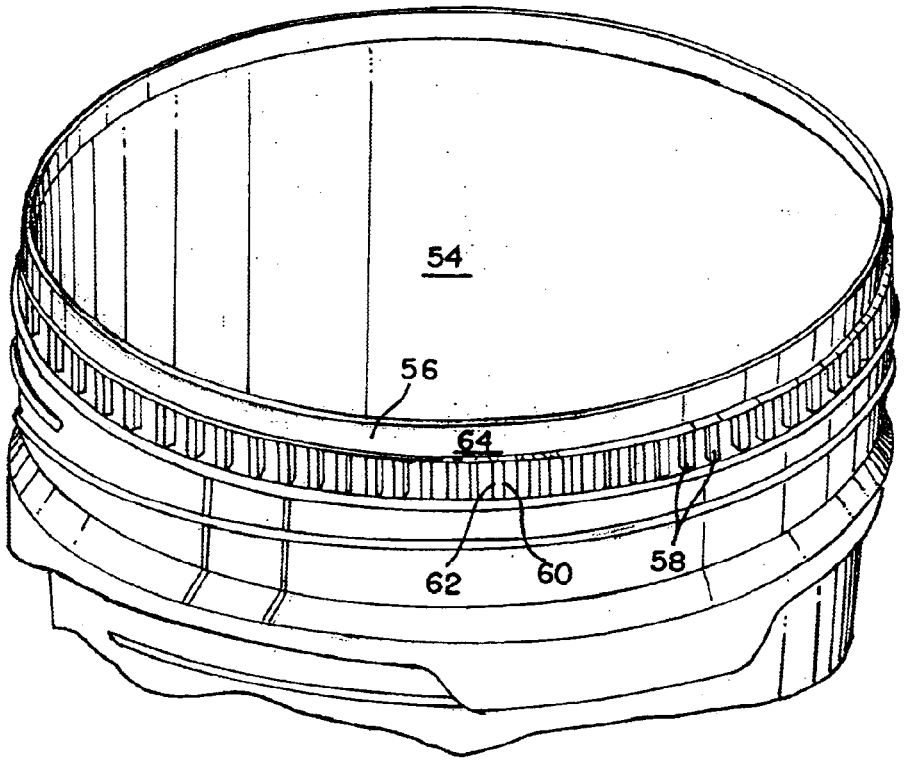
FIG. 4 is perspective view of a top portion of the container of FIG. 1.
Figure 5:
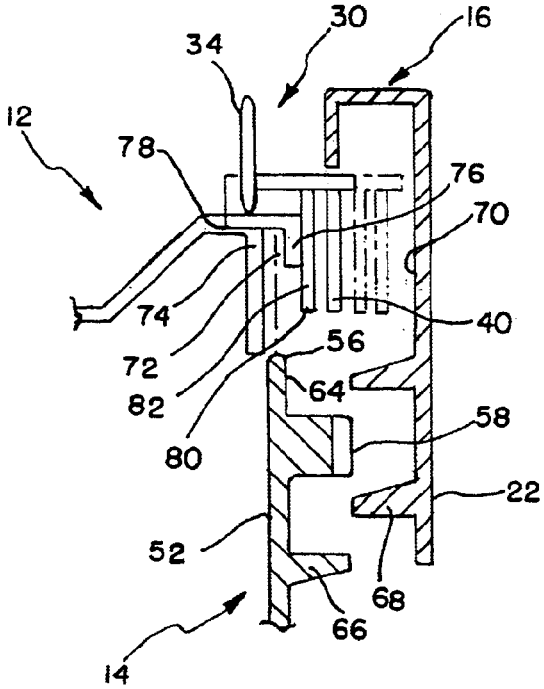
FIG. 5 is an exploded cross sectional view of the lid apart from the container showing the placement of the container relative to the lid when threadably engaged thereto with the locking mechanism.

Details of the lid 12 may be better seen in FIGS. 2 and 3, while FIG. 4 shows details of the container 14. FIG. 5 shows the connection of the lid 12 with the container 14 which is at least partially obscured from view in FIG. 1.

The lid 12 has a center portion 18 preferably surrounded by a ridge 20. The ridge 20 is defined and/or bounded by a downwardly extending outer wall 22. If the ridge 20 is not utilized, the downwardly extending outer wall 22 surrounds the center portion 18. The ridge 20 illustrated is formed from the downwardly extending outer wall 22, a top portion 24, and an inner wall 26. A shelf 28 is illustrated extending from the inner wall 26. The locking member 30 of the locking mechanism 16 is shown at least partially supported by the shelf 28. The shelf 28 preferably is planar to one or both of the center portion 18 and the top portion 24 of the ridge 20. The shelf 28 is also illustrated a distance from the center portion 18.

FIG. 1 also shows tamper indicator 100 in an installed configuration. After the pail has been filled with a product, the tamper indicator 100 is installed. With the tamper indicator 100 installed, the lid 12 cannot be removed without first removing or breaking at least a portion of the tamper indicator 100. As will be explained in further detail below, the tamper indicator 100 preferably cannot be removed without breaking a portion of it, thereby indicating that the lid 12 has likely been removed from the container 14 at least once, or at least that the tamper indicator 100 has been purposefully triggered.

The tamper indicator 100 of the preferred embodiment has a tether 102 which connects a stop 104 to the locking mechanism 16. The stop 104 has a ledge 106 supported by a rest 108 on the shelf 28 of the lid 12. The majority of the other portions of the tamper indicator 102 are hidden from view in FIG. 1 on the other side of the inner wall 26. Second opening 110 is shown in FIG. 1 which allows the stop 104 to be positioned as illustrated.

FIG. 2 shows a ledge 32 extending from the shelf 28 to provide a little more room for operating the locking member 30. The locking member 30 is comprised of a finger 34 which is pivotable about pivot 38. The finger 34 is connected to an arm 36 which connects to a downwardly extending leg 40 which is shown in FIGS. 3 and 5.

Spring member 42 biases the finger, and thus the arm 36 and leg 40 into a locking position shown in the figures. Application of force to the finger 34 sufficient to overcome the bias of the spring member 42 moves the finger 34 about the pivot 38. The leg 40 is then moved away from the center portion 18 of the lid 12. Furthermore, as shown in FIG. 5, as the leg 40 moves away from the center portion 18 of the lid 12, the leg 40 also moves out of engagement with one or more of the teeth as will be explained in more detail below.

As shown in FIG. 1, protecting walls 44,46,48 provide protection to the locking member 30, especially when stacking multiple container assemblies 10 on top of one another. A portion of protecting walls 46,48 is shaped to allow for easy operation of the finger by providing access to the finger 34.

Figure 6:
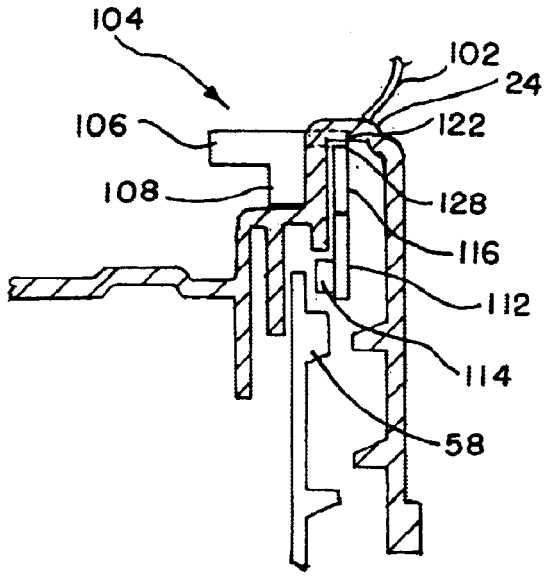
FIG. 6A is an exploded cross sectional view of the lid apart from the container showing the placement of the container relative to the lid when threadably engaged thereto with the tamper indicator installed.
FIG. 6B is an exploded cross sectional view of the lid connected to the container showing the placement of the container relative to the lid when threadably engaged thereto with the tamper indicator installed.
Figure 7:
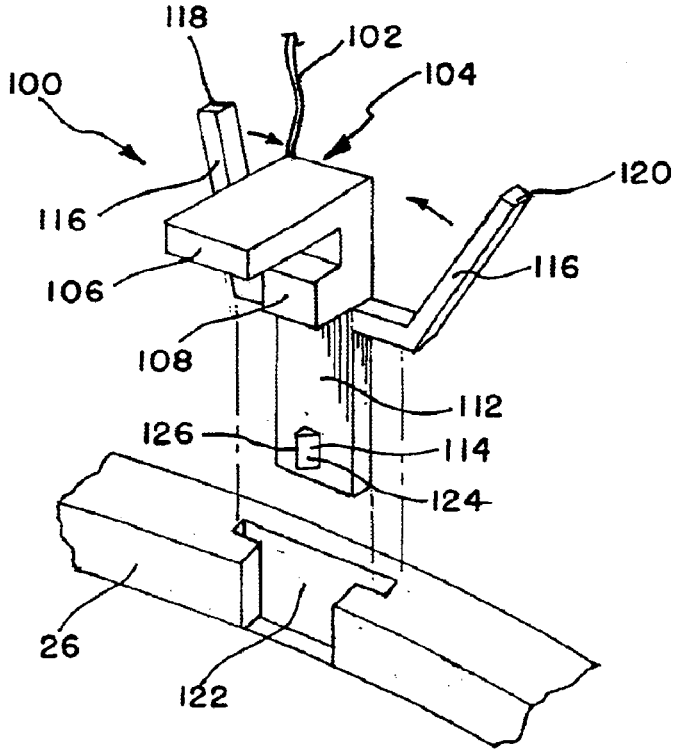
FIG. 7 is a elevational exploded view showing the installation of the tamper indicator relative to the lid.

FIG. 2 shows some of the tamper indicator 100 which was hidden from view in FIG. 1 since it is not installed intermediate the lid 12 and container 14. Specifically, protrusion 112 is illustrated extending from the stop 104. The ledge 106 and rest 108 preferably abut the protrusion 112 which extends downwardly relative to the rest 108. The protrusion has a toe 114 which extends therefrom. The toe 114 is preferably constructed somewhat similarly to the leg 40 of the locking mechanism 16 as will be described in more detail with reference to FIGS. 5 and 6.

As shown in FIGS. 2 and 3, the stop 104 further comprises barbs 116 which preferably extend laterally and upwardly away from the protrusion 112. At least one of the barbs 116 is preferably resilient as the distance between ends 118,120 is greater than the length of the trough 122 in the second opening 110. Accordingly, the at least one of the barbs 116 is displaced toward the other barb 116 so that the stop 104 may be inserted as shown in FIG. 1 into the lid 12. The barbs 116 then extend or expand to a longer distance than the length of trough 122 to prevent the stop 104 from being pulled out without a portion of the stop 104 breaking off.

The lid 12 includes a first opening 50 which allows the leg 40 and/or arm 36 of the locking member 30 to pass through from the top side of the lid 12 shown in FIG. 2 to the bottom side shown in FIG. 3. The first opening 50 is positioned relative to the open ended container 14 when connected together such that the cutout is radially outward of the interior wall surface 52 of the container 14. This may be better illustrated after explaining the construction of the container 14 as shown in FIG. 4 and visualizing the operation of the locking mechanism as illustrated in an exploded view in FIG. 5.

The container has an interior wall surface 52 which defines a cavity 54 therein. The cavity 54 is where material, such as liquid or solid particles, is stored in the container 14. The inner wall surface 52 is preferably substantially smooth and continuous extending in a cylindrical manner to the top 56 of the open ended container 14. On the exterior of the container 14 are outwardly facing teeth 58. Each of outwardly facing teeth 58 preferably have a ramped surface 60 and a substantially radially extending surface 62 as shown in FIG. 4. The teeth are illustrated as spaced by rim 64 from the top 56 of the container 14.

Below the teeth 58 are one or more outwardly facing threads 66. The outwardly directed threads 66 of the container 14 cooperate with inwardly directed threads 68 on the inner surface 70 of the outer wall 22 of the lid 12. As the lid 12 is rotated relative to the container 14, the threads 66,68 allow for the lid 12 to be connected and disconnected from the container 14.

As the lid 12 is being secured to the container 14 by rotating the threads 66,68 relative to one another, the rim 64 preferably locates within slot 72 in the bottom of the lid 12. The slot 72 is defined by interior projection 74 and exterior projection 76. A sealing ring 78 may be located within the slot 78 in some embodiments, or the fit of the rim 64 within the slot 72 may be sufficient to create a watertight seal when the lid 12 is completely closed relative to the container 14.

As the lid 12 is being tightened relative to the container 14, the leg 40, a blade 80 on the leg 40 contacts the teeth 58. It is preferred that the blade 80 has a ramped surface 82 so that the ramped surface 82 of the blade 80 and the ramped surface 60 of the teeth 58 act against one another to force the leg 40 away from the center portion 18 of the lid 12 to allow the lid 12 to be tightened.

However, when one attempts to "unscrew" the lid 12 from the container, the back surface 84 of the leg 40 contacts the radially extending surface 62 of at least one of the teeth 58 and prevents rotation in the "off" direction. In order to remove the lid 12 from the container 14, the leg 40 must be moved, such as by pushing on the finger 34 which moves the leg 40 with the blade 80 outwardly away from the center portion 18 of the lid 12 and out of contact with the teeth 58. This allows for the outward rotation of the lid 12 relative to the container 14. Without moving the leg 40 out of the way, the back surface 84 and radially extending surface 62 contacting one another make removal of the lid 12 very difficult, if not almost impossible, since these contacting surfaces will prevent rotation in the "outward" direction.

Just like the blade 80 has ramped surface 82, it is preferred that the toe 114 on the protrusion 112 have a ramped surface 124 opposite a flat and radial extending surface 126. The ramped surface cooperates with the ramped surfaces on the teeth 58 (if utilized) so that during tightening, the ramped surfaced can work together to outwardly displace the protrusion 112 when the stop 104 is installed. However, if one were to attempt to untighten the lid 12, the flat surface 126 would contact a flat surface of the teeth 58 to prevent further rotation. If a predetermined amount of force is reached, the protrusion 112 will break from the stop 104 to indicate that the lid 12 has probably been opened. Alternatively, other portions of the stop 104 may break in other embodiments.

The preferred method of triggering the tamper indicator 100 is to lift up on the ledge 106 which causes the barbs 116 to grab the underside 12B of the ridge 24 until either the protrusion 112 or one or more of the barbs 116 break from the stop 104. Whatever breaks off can then fall downwardly away from the lid 12 which will be external to the internal volume of the container 14. The remaining portion can be lifted out of the second opening 113.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A container assembly comprising an open ended container having outwardly directed threads on an outer exterior wall surface of the container and a plurality of spaced apart teeth extending outwardly relative to the outer exterior wall surface and located intermediate the threads and a top of the container; and a lid having a downwardly extending outer wall having inwardly directed threads, a first opening in the lid, and a tamper indicator, said inwardly directed threads of said lid configured to cooperate with the outwardly directed threads of said container to secure the lid relative to the container, said tamper indicator having an initial pre-installation position and an installed position, and when in said installed position, at least a portion of said tamper indicator extending through the first opening and engaging at least one of said plurality of teeth to prevent unsecuring the lid relative to the container without first breaking at least a portion of the tamper indicator.

2. The container of claim 1 wherein rotating of said lid relative to said container in at least one direction loosens and subsequently disconnects the lid from the container, and said tamper indicator prevents disconnection of the lid from the container until at least a portion of the tamper indicator is broken when in the installed position.

3. The container of claim 1 further comprising a locking member normally biased to a first position in engagement with the plurality of teeth and moveable to a second position to allow rotation of the lid relative to the lid in at least one direction.

4. The container of claim 3 wherein movement of the locking mechanism to the second position disengages the locking mechanism from the at least one of the teeth to allow for rotation of the lid relative to the container in at least one direction.

5. The container of claim 4 further comprising a second opening in the lid and wherein the locking member further comprises a finger rotatably mounted about a pivot, an arm connected to the finger, and a leg connected to the arm, wherein at least one of said leg and arm extend through the second opening.

6. The container of claim 5 wherein the tamper indicator further comprises a stop tethered to the finger of the locking mechanism.

7. The container of claim 1 wherein the tamper indicator further comprises a stop having a rest which contacts a shelf of the lid when in the installed position.

8. The container of claim 7 wherein the tamper indicator further comprises a protrusion which extends from the stop downwardly toward the teeth when in the installed position.

9. The container of claim 1 wherein the lid further comprises a ridge and the first opening is at least partially in the ridge.

10. The container of claim 9 wherein the ridge is defined by an interior wall, a top portion, and the outer wall of the lid.

11. The container of claim 8 further comprising a toe extending from the protrusion, said toe having a slanted surface allowing the tightening of the lid relative to the container and a blocking surface which engages at least one tooth when loosening of the lid is attempted when the tamper indicator is in the installed position.

12. The container of claim 7 wherein the tamper indicator further comprises at least one barb, said barb deflected when transitioning from the pre-installation position to the installed position, and when in the installed position, said barb preventing the tamper indicator from being withdrawn from the first opening without first breaking a portion of the tamper indicator.

13. A container assembly comprising an open ended container having a container wall with an interior surface defining a cavity therein, and an outer exterior surface with outwardly directed threads thereon and at least one outwardly extending latch member on the exterior surface; and a lid having a downwardly extending outer wall with inwardly directed threads, a first opening in the lid, a tamper indicator extending through the first opening, said inwardly directed threads of said lid configured to cooperate with the outwardly directed threads of said container to secure the lid relative to the container, and a locking member normally biased towards the a least one latch member in a first position and moveable to a second position to allow rotation of the lid relative to the container in an unscrewing direction, said tamper indicator having a pre-installation position and an installed position, and when in said installed position, at least a portion of said tamper indicator extending through the first opening and preventing rotation of the lid relative to the container in the unscrewing direction until the tamper indicator is broken, said tamper indicator contacting one of the at least one latch member in the installed position wherein only one of the tamper indicator when in the installed position and the locking member when in the first position contact a particular one of the at least one latch member.

14. The container of claim 13 wherein the at least one latch member is located intermediate the outwardly directed threads and the top of the container.

15. The container of claim 13 wherein the tamper indicator has a protrusion extending downwardly from a stop toward the at least one latch member when in the installed position.

16. The container of claim 13 wherein the tamper indicator further comprises at least one barb, and the at least one barb prevents the tamper indicator from being withdrawn from the first opening in the lid when in the installed position.

17. The container of claim 13 wherein the at least one latch member further comprises a plurality of outwardly directed teeth and the teeth have a ramped surface and a radially outwardly directed surface.

18. The container of claim 17 wherein when the lid is connected to the container, the tamper indicator cooperates with at least one of the teeth to lock the lid when in the installed position.

19. The container of claim 13 wherein the tamper indicator is tethered to the lid in the pre-installation position.

20. The container of claim 13 wherein the lid further comprises a second opening and at least a portion of the locking mechanism extends through the second opening.

* * * * *